US005906162A

United States Patent [19]

Kolbe et al.

[11] Patent Number: 5,906,162

[45] Date of Patent: May 25, 1999

[54] METHOD OF PRINTING IN PRINTING MACHINE WITH MOVABLE BEARINGS BLOCKS TO PERMIT AXIAL REMOVAL OF CYLINDER

[75] Inventors: Wilfried Kolbe, Gülzow; Bodo Steinmeier, Bielefeld; Manfred Terstegen, Bielefeld; Klaus Schirrich, Bielefeld, all of Germany

[73] Assignee: Fischer & Krecke GmbH, Bielefeld, Germany

[21] Appl. No.: 09/145,731

[22] Filed: Sep. 2, 1998

Related U.S. Application Data

[63] Continuation of application No. 08/868,097, Jun. 3, 1997, Pat. No. 5,832,829.

[30] Foreign Application Priority Data

Jun. 12, 1996 [EP] European Pat. Off. ..... 96109372

[51] Int. Cl.[6] ..... B41F 13/20; B41F 13/00

[52] U.S. Cl. ..... 101/352.01; 101/351.1; 101/216; 101/247

[58] Field of Search ..... 101/216, 217, 101/375, 153, 247, 351.1, 352.01, 357, 358; 384/434, 435, 436

[56] References Cited

U.S. PATENT DOCUMENTS

| | | | |
|---|---|---|---|
| Re. 33,944 | 6/1992 | Knauer | 101/216 |
| Re. 34,970 | 6/1995 | Tittgemeyer | 101/216 |
| 3,611,926 | 10/1971 | Johnson | 101/247 |
| 3,889,596 | 6/1975 | Thomas et al. | 101/352.01 |
| 4,308,796 | 1/1982 | Satterwhite | 101/217 |
| 4,393,774 | 7/1983 | Figg | 101/288 |
| 4,528,908 | 7/1985 | Davison et al. | 101/295 |
| 5,099,760 | 3/1992 | Schneider | 101/351.4 |
| 5,127,746 | 7/1992 | Rogge et al. | 384/436 |
| 5,370,047 | 12/1994 | Compton | 101/375 |
| 5,481,972 | 1/1996 | Schmid | 101/216 |
| 5,669,302 | 10/1997 | Rogge et al. | 101/247 |

FOREIGN PATENT DOCUMENTS

| | | |
|---|---|---|
| 0438733 | 7/1991 | European Pat. Off. . |
| 0443160 | 8/1991 | European Pat. Off. . |
| 2221188 | 9/1973 | Germany . |

*Primary Examiner*—Edgar Burr
*Assistant Examiner*—Leslie Grohusky
*Attorney, Agent, or Firm*—Richard M. Goldberg

[57] ABSTRACT

A printing machine with preferably several inking units, which are disposed on a common back-pressure cylinder (12), with in each case at least one roll body (16, 18), which is held with its two opposite ends in two bearing blocks (22, 24) that can be moved approximately radially with respect to the back-pressure cylinder, and is held with its one end in a hinged bearing (42), fastened to the bearing block (22) there, while it is clamped with its other end in a cantilever manner in a holding device (26), it being possible to move the holding device and the hinged bearing in such a manner relative to one another that, after the hinged bearing is lifted up, the roll body can be moved out of this bearing and then removed in an axial direction, characterized in that the hinged bearing (42), in the lifted-up state, is open in the direction of movement of the associated bearing block (22) and, by moving this bearing block in the direction approximately radial to the back-pressure cylinder (12), can be moved into the position, which permits the axial removal of the roll body (16, 18).

13 Claims, 2 Drawing Sheets

METHOD OF PRINTING IN PRINTING MACHINE WITH MOVABLE BEARINGS BLOCKS TO PERMIT AXIAL REMOVAL OF CYLINDER

This application is a continuation, of application Ser. No. 08/868,097 filed on Jun. 3, 1997, now U.S. Pat. No. 5,832, 829.

BACKGROUND OF THE INVENTION

The invention relates to a printing machine. In particular, the invention is concerned with a system for exchanging an impression cylinder and/or an inking roller in the inking unit of a flexographic printing machine.

In the European patent application 95 116 394, an apparatus is described for exchanging the sleeve of an impression cylinder, which is provided at both ends with bearing journals. The bearing journals are mounted in each case in a hinged bearing in a bearing block, which can be moved approximately radially in relation to the back-pressure cylinder for moving the sleeve of the impression cylinder against or away from a back-pressure cylinder. A shaft, running axially through the impression cylinder sleeve, is clamped at one end in a lifting system in such a manner that, after the bearing is lifted up, the impression cylinder sleeve can be lifted with the help of the shaft and the lifting system vertically into a position, in which the impression cylinder sleeve can be pulled axially from the sleeve.

For such printing machines, the bearing blocks for the impression cylinder typically are guided on a guide rail, which is mounted on the upper side of a console fastened at the side part in question of the printing machine. The inking roller is mounted in a corresponding manner, so that it can be lifted out of the bearing blocks, which can also be moved radially in relation to the back-pressure cylinder for moving the impression cylinder against or away from the inking roller. The bearing blocks for the inking rollers can also be guided on the same guides as the bearing blocks for the impression cylinder.

For the arrangement described above, the construction of the lifting system for lifting the printing-cylinder sleeve and the inking roller is expensive. If several inking units are disposed in the usual manner on the same back-pressure cylinder, the vertical distance between the inking units furthermore must be relatively large, so that there is sufficient free space for lifting the impression cylinders and inking rollers. Furthermore, very difficult adjustment work is required during the installation in conjunction with fastening the consoles to the side parts of the printing machine and in conjunction with installing the guide rails on the consoles.

SUMMARY OF THE INVENTION

It is an object of the invention to provide a printing machine, which has a simplified construction and, nevertheless, permits the impression cylinders and/or the inking rollers to be exchanged simply.

The object of the invention accordingly is a printing machine with preferably several inking units disposed on a conimon back-pressure cylinder with in each case one roll body (impression cylinder or inking roller), which is held with its two opposite ends in two bearing blocks that can be moved approximately radially in relation to the back-pressure cylinder and is held with its one end in a hinged bearing, fastened to the bearing block there, while it is clamped with its other end in a cantilever manner in a holding device, it being possible to move the holding device and the hinged bearing relative to one another in such a manner that, after the hinged bearing is lifted up, the roll body can be moved out of this bearing and then removed in the axial direction, characterized in that, in the lifted-up state, the hinged bearing is open in the direction of movement of the associated bearing block and, by moving this bearing block in the direction approximately radial in relation to the back-pressure cylinder, can be moved into the position, which permits the axial removal of the roll body.

Accordingly, pursuant to the invention, the bearing blocks are moved exclusively linearly in a single direction, namely approximately radially to the back-pressure cylinder when they are moved against or away from the back-pressure cylinder as well as when the impression cylinder is exchanged, and therefore no additional lifting system is required for lifting the impression cylinder and the inking roller out of the hinged bearings. Only a single driving and guiding system is required for moving the bearing blocks linearly during the various steps of the process. An appreciable structural simplification is achieved by these means. In addition, a tighter arrangement of the inking units at the back-pressure cylinder is possible, since free space is not required for the vertical movements of the impression cylinder and the inking rollers.

Yet another object of the invention is a printing machine with a back-pressure cylinder mounted between side parts of the machine frame and, preferably, several inking units with, in each case, at least one roll body (impression cylinder or inking roller), which is mounted with its opposite ends in bearing blocks and, with guides held at the side parts, on which guides the bearing blocks are guided in such a manner, that the roll body can be moved approximately radially in relation to the back-pressure cylinder, characterized in that the guides are mounted at the inner surfaces of brackets, formed in one piece with the respective side parts and positioned at the brackets with the help of pins engaging boreholes in the brackets.

By means of this construction, an appreciable simplification of the manufacture and installation is achieved. Since the brackets are formed in one piece with the side parts of the machine frame, the mounting and adjusting of separate consoles becomes unnecessary. The boreholes, used to position the guides, can be pre-drilled precisely during the manufacture of the side parts, so that correct positioning and alignment of the guides for the bearing blocks is ensured. For mounting the guides at the inner surface of the brackets, only the pins thus have to be inserted into the appropriate boreholes, so that expensive adjusting work is not required.

The supporting arms for the different inking units, formed in one piece with the side parts, can be connected together at the free ends, so that only windowlike recesses, which permit the impression cylinders and the inking rollers to be pulled out axially, need be formed in the side parts.

BRIEF DESCRIPTION OF THE DRAWINGS

In the following, a preferred example of the invention is explained in greater detail by means of the drawing, in which.

DESCRIPTION OF THE PREFERRED EMBODIMENTS

Figure 1:
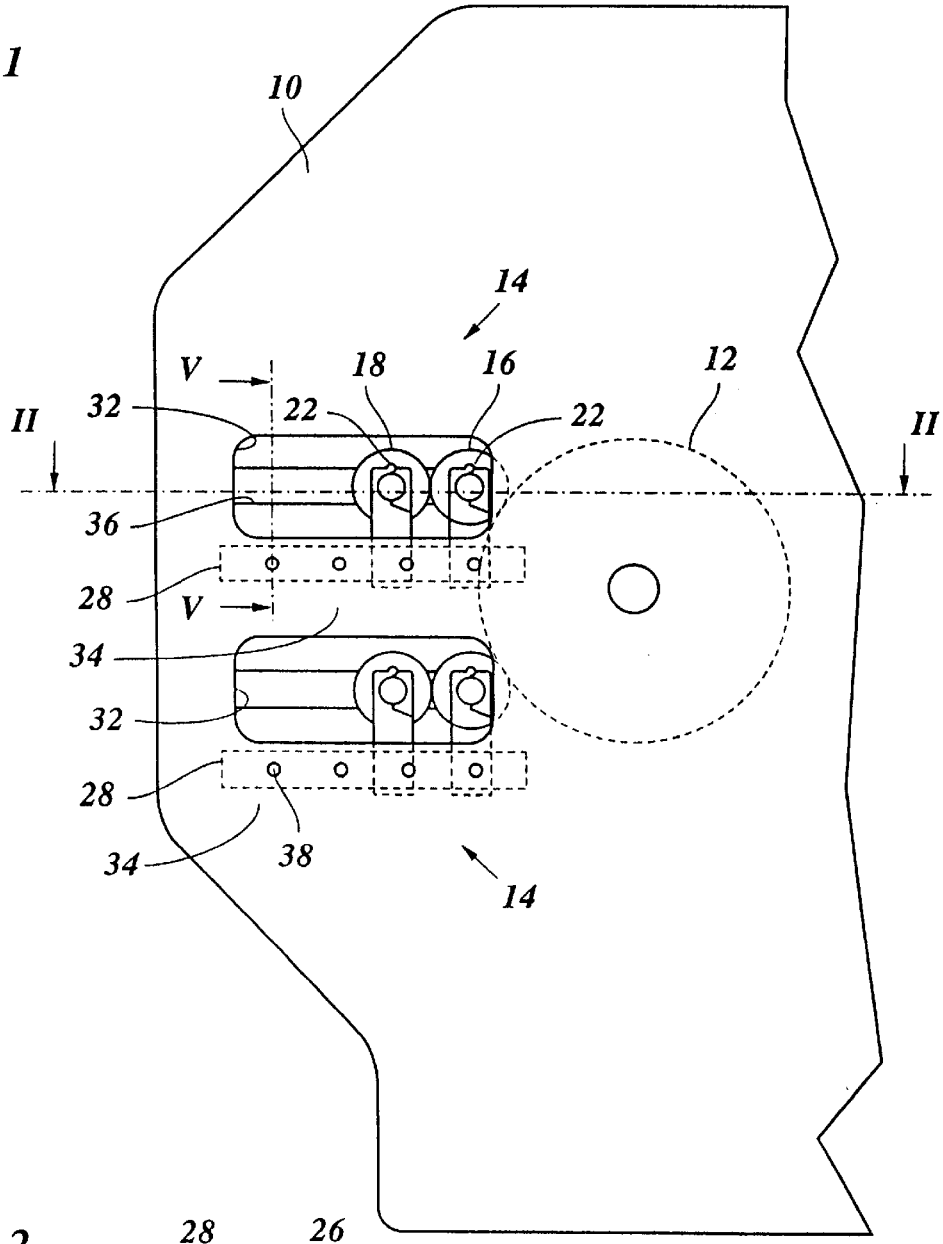
FIG. 1 shows a diagrammatic side view of a printing machine.
Figure 2:
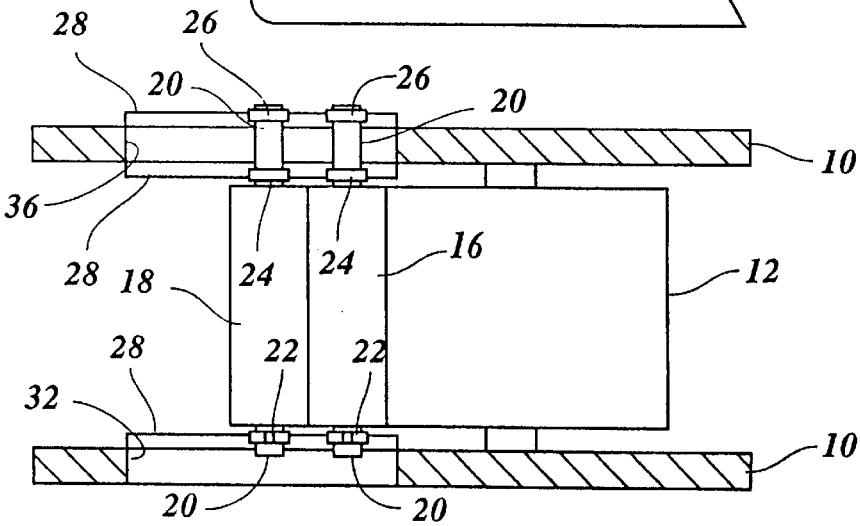
FIG. 2 shows a section along the line II—II of FIG. 1, FIGS. 3 and 4 show views of details of FIG. 1 for various operating phases of a cylinder exchange

According to FIGS. 1 and 2, the printing machine has a machine frame with two parallel, panel-shaped side parts 10, between which a back-pressure cylinder 12 is mounted. At the periphery of the back-pressure cylinder 12, several inking units 14 are disposed, of which only two are shown in FIG. 1. Each inking unit has an impression cylinder 16, which can be set against the back-pressure cylinder 12, and an ink roller (engraved ink transfer cylinder) 18, which can be set against the impression cylinder. Each impression cylinder 16 and each inking roller 18 are provided at both ends with axle journals 20 and mounted in bearing blocks 22, 24, 26. The mutually corresponding bearing blocks of the impression cylinder 16 and the ink rollers 18 of each inking unit are guided on a common guide 28 and can be moved with the help of known driving means 30 (FIG. 5) independently of one another in the longitudinal direction of the guides 28, so that the inking roller 18 can be moved away from the periphery of the impression cylinder 16 and the impression cylinder can be moved away from the periphery of the back-pressure cylinder 12. Accordingly, the guides 28 run approximately radially in relation to the axis of rotation of the back-pressure cylinder 12.

The side parts 10 of the machine frame are dimensioned so that the inking units 14 lie almost completely between these side parts. For each inking unit 14, the side part 10, facing the viewer in FIG. 1, has a window-like recess 32, through which the impression cylinder 16 and the inking roller 18 of the inking unit in question are accessible. The regions of the side wall 10 between or below the recesses 32, function as brackets 34, at which the guides 28 are fastened. Instead of the window-like recess 32, the side part 10, averted from the viewer in FIG. 1, only has a narrower, slot-like recess 36.

At least two of the guides 28, constructed as prismatic rails, are mounted at mutually facing inner surfaces of the side wall 10 and positioned there with the help of pins 40 (FIG. 5) engaging boreholes 38 of the side parts.

Figure 3:
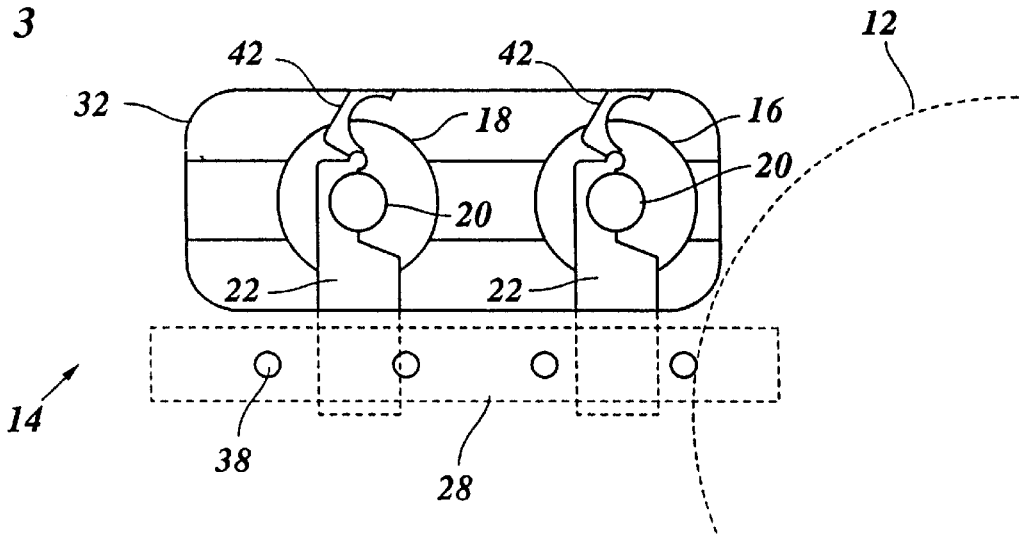

As is evident from FIG. 3, the bearing blocks 22 are provided with hinged bearings 42, the cap pieces of which are hinged to the bearing block in such a manner, that the axle journals 20 can be moved laterally, that is, in the direction parallel to the guide 28, out of the bearing block after the cap piece of the bearing is opened.

When the impression cylinder 16 and the inking roller 18 of an inking unit 14 are to be exchanged, the bearing blocks 22, 24 and 26 are initially moved into the position shown in FIG. 3, in which the impression cylinder 16 is moved away from the back-pressure cylinder 12 and the inking roller 18 is moved away from the impression cylinder 16. Subsequently, the cap pieces of the bearings are opened. After that, only the bearing blocks 22 are moved further into the position shown in FIG. 4, so that they release the axle journals 20. The impression roller 16 and the inking roller 18 are then held by the bearing blocks 24 and 26 only at their ends, which are not visible in FIG. 4. The bearing blocks 26, mounted on the outside at the left side part 10 in FIG. 5, are intended to absorb tilting moments of the impression cylinder and of the inking roller. Alternatively, they can, however, be replaced by any other clamping, device for the axle journals.

Figure 4:
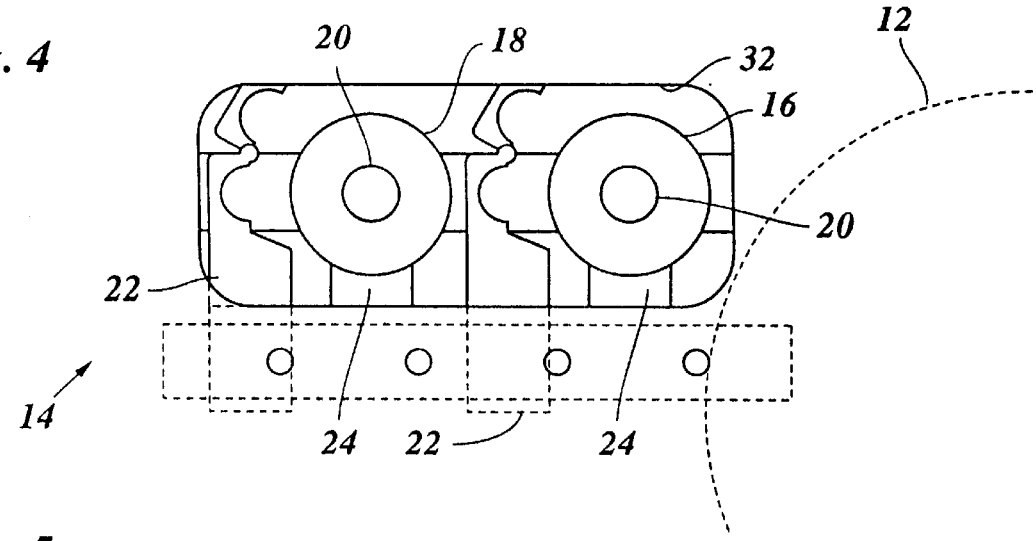
Figure 5:
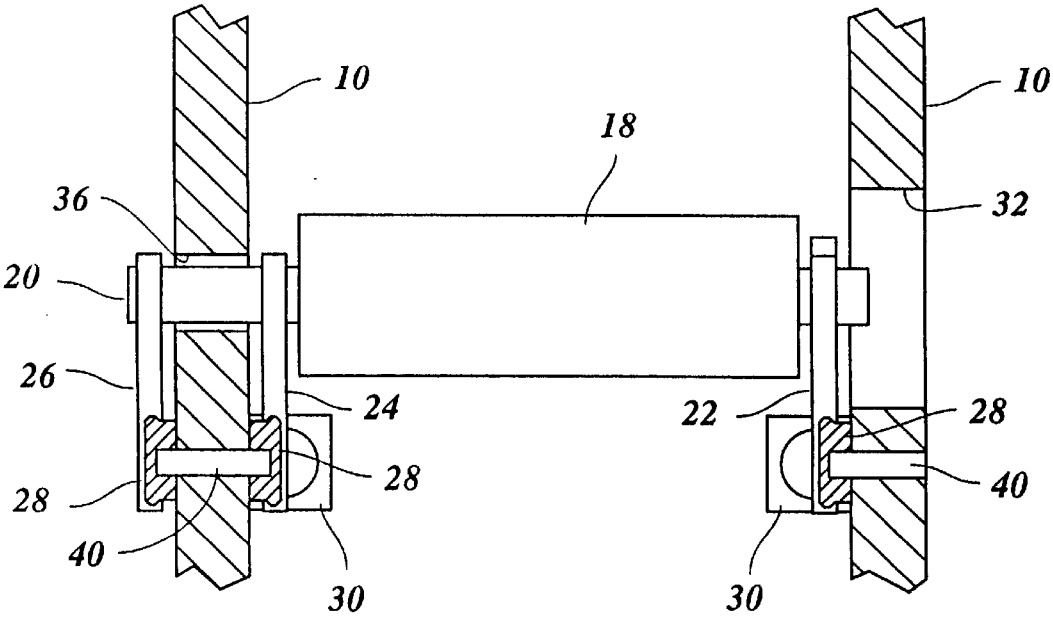
FIG. 5 shows a partial section along the line V—V of FIG. 1.

In the state shown in FIG. 4, the impression cylinder 16 and the inking roller 18 can be pulled out axially, for example, with the help of a robot, that is in the direction of the viewer, from their bearings at the bearing blocks 24, 26 and taken through window-like recesses 32 out of the machine frame. Likewise, by means of a reversal of the movements described above, a new impression cylinder and a new inking roller can be inserted.

In the example shown, the impression cylinder 16 and the inking roller 18 are exchanged completely. In a different embodiment, it is, however, also possible to use a so-called sleeve system, for which the impression cylinder 16 and/or the inking roller 18 carry an exchangeable sleeve on their periphery. In this case, the axle journals 20 remain clamped at all times in the bearing blocks 24, 26 on the rear of the machine frame and only the sleeves are pulled off from the imprint cylinder or the inking roller and exchanged through the window-like recesses 32.

In the simplified representation of the drawing, the hinged bearings, formed by the bearing blocks 22, are shown as sliding bearings. In practice however, ball bearings are disposed in the usual manner on the axle journals 22. These ball bearings always remain on the axle journals and lie with their outer ring in the bearing block and are secured there by the cap piece of the bearing. The cap piece of the bearing is provided with locking devices, which are not shown, so that it can be locked in the closed position.

Preferably, the bearing blocks are supported on the guides 28 with the help of revolving ball systems, so that they can be shifted easily on the guides.

Although, in the embodiment shown here, the guides 28 lie laterally next to the side parts 10 of the machine frame, the weight forces of the inking unit can also be absorbed stably by the pins 40, particularly if, as in the example shown, the guides lie flush against the side parts 10. It goes without saying that the guides 28 can be secured additionally at the side parts by screws and the like, which are not shown.

What is claimed is:

1. A method of exchanging at least one roll body in a printing machine, the method comprising the steps of:

providing a printing machine including:

a common back-pressure cylinder;

a plurality of inking units disposed on said common back-pressure cylinder; and each inking unit including:

at least two bearing blocks movable independently from one another in a direction approximately radial with respect to the back-pressure cylinder, at least one of said bearing blocks having a releasable bearing, and at least another of said bearing blocks being a holding device, and at least one said roll body, each roll body having two opposite ends, one end of each roll body held releasably in one said releasable bearing of a respective bearing block and an opposite end of each roll body clamped in one said holding device in a cantilever manner;

releasing said one end of said roll body from said releasable bearing;

moving said at least two bearing blocks relative to one another in the direction approximately radial to the back-pressure cylinder into a position permitting axial removal of said roll body from said holding device; and axially removing said roll body from said holding device.

2. A method according to claim 1, wherein the roll body is an impression cylinder.

3. A method according to claim 1, wherein the roll body is an inking roller.

4. A method according to claim 1, wherein said step of moving includes the step of moving one of said at least two bearing blocks along guides mounted at inner surfaces of brackets formed in one piece with side parts of a machine frame.

5. A method according to claim 1, wherein said step of removing includes the step of removing said roll body through window-like recesses in at least one side part of the printing machine.

6. A method according to claim 1, wherein said releasable bearing is a hinged bearing, and said step of releasing includes the step of opening said hinged bearing to release said one end of said roll body from said hinged bearing.

7. A method of exchanging at least one roll body in a printing machine, the method comprising the steps of:

providing a printing machine including:

common back-pressure cylinder;

a plurality of inking units disposed on said common back-pressure cylinder; and each inking unit including:

at least two bearing blocks movable in a direction approximately radial with respect to the back-pressure cylinder, at least one of said bearing blocks having a releasable bearing, and at least another of said bearing blocks being a holding device, and at least one said roll body, each roll body having two opposite ends, one end of each roll body held releasably in one said releasable bearing of a respective bearing block and an opposite end of each roll body clamped in one said holding device in a cantilever manner;

moving said at least two bearing blocks in the direction approximately radial to the back-pressure cylinder into a position permitting axial removal of said roll body from said holding device;

releasing said one end of said roll body from said releasable bearing; and axially removing said roll body from said holding device.

8. A method according to claim 7, further including the step of further moving at least one bearing block relative to another bearing block in the direction approximately radial to the back-pressure cylinder after said step of releasing and prior to said step of axially removing.

9. A method according to claim 7, wherein the roll body is an impression cylinder.

10. A method according to claim 7, wherein the roll body is an inking roller.

11. A method according to claim 7, wherein said step of moving includes the step of moving one of said at least two bearing blocks along guides mounted at inner surfaces of brackets formed in one piece with side parts of a machine frame.

12. A method according to claim 7, wherein said step of axially removing includes the step of removing said roll body through window-like recesses in at least one side part of the printing machine.

13. A method according to claim 7, wherein said releasable bearing is a hinged bearing, and said step of releasing includes the step of opening said hinged bearing to release said one end of said roll body from said hinged bearing.

* * * * *